United States Patent [19]

Korff et al.

[11] Patent Number: 4,982,027

[45] Date of Patent: Jan. 1, 1991

[54] PROCESS FOR THE REPROCESSING OF CARBON CONTAINING WASTES

[75] Inventors: Joachim Korff, Bornheim; Axel Giehr, Wesseling; Karl-Heinz Keim, Swissttal; Kurt Erdt, Windhagen/Westerwald, all of Fed. Rep. of Germany

[73] Assignee: Rheinische Braunkohlenwerke AG, Cologne, Fed. Rep. of Germany

[21] Appl. No.: 303,028

[22] Filed: Jan. 26, 1989

Related U.S. Application Data

[63] Continuation of Ser. No. 4,654, Jan. 20, 1987, abandoned.

[30] Foreign Application Priority Data

Jan. 24, 1986 [DE] Fed. Rep. of Germany ..... 3602041

[51] Int. Cl.[5] ..... C10G 67/06

[52] U.S. Cl. ..... 585/24; 585/240; 585/242; 208/13; 208/412; 208/413; 208/179; 423/DIG. 18

[58] Field of Search ..... 585/240, 241, 242; 423/DIG. 18; 208/13, 412, 413, 179; 44/50, 61

[56] References Cited

U.S. PATENT DOCUMENTS

| | | | |
|---|---|---|---|
| 1,251,954 | 1/1918 | Billwiller | 585/240 |
| 1,864,687 | 6/1932 | Fields | 585/240 |
| 1,959,467 | 5/1934 | Fields | 585/240 |
| 2,220,624 | 11/1940 | Sherrard | 585/240 |
| 2,551,579 | 5/1951 | Beil | 585/240 |
| 3,223,698 | 12/1965 | Oshima et al. | 585/240 |
| 3,704,108 | 11/1972 | Alpert | 585/241 |
| 4,089,773 | 5/1978 | Espenscheid | 585/240 |
| 4,108,730 | 8/1978 | Chen et al. | 585/241 |
| 4,145,188 | 3/1979 | Espenscheid et al. | 585/240 |
| 4,175,211 | 11/1979 | Chen | 585/241 |
| 4,251,500 | 2/1981 | Morita et al. | 585/241 |
| 4,273,643 | 6/1981 | Bennet | 585/240 |
| 4,313,011 | 1/1982 | Weil et al. | 585/240 |
| 4,364,745 | 12/1982 | Weil | 585/240 |
| 4,396,786 | 8/1983 | Bond | 585/240 |
| 4,463,203 | 7/1985 | Gi | 585/241 |
| 4,526,675 | 7/1985 | Mahoney et al. | 585/240 |
| 4,584,421 | 4/1986 | Saito et al. | 585/241 |
| 4,618,736 | 10/1986 | Benn et al. | 585/240 |
| 4,652,686 | 3/1987 | Coenen et al. | 585/240 |
| 4,670,613 | 6/1987 | Ruyter et al. | 585/240 |

FOREIGN PATENT DOCUMENTS

| | | | |
|---|---|---|---|
| 1100532 | 5/1981 | Canada | 585/240 |
| 0157339 | 10/1985 | European Pat. Off. . | |
| 2162436 | 6/1972 | Fed. Rep. of Germany . | |
| 2258341 | 6/1973 | Fed. Rep. of Germany . | |
| 2721290 | 11/1978 | Fed. Rep. of Germany | 585/240 |
| 2930032 | 1/1981 | Fed. Rep. of Germany | 585/240 |
| 2089831 | 6/1982 | United Kingdom | 585/240 |
| 2106128 | 4/1983 | United Kingdom . | |

OTHER PUBLICATIONS

"Hydrogenation of Waste Tires", Rubber Age, Wolk et al., Jun. 1974, pp. 27–38.

"Die Katalytische Druckhydrierung von Kohlen, Teeren und Mineralolen" (Catalytic Pressure Hydrogenation of Coal, Tar and Mineral Oil), Kronig, Springer Verlag; 1950, pp. 15–16.

*Primary Examiner*—Helane E. Myers

[57] ABSTRACT

This invention relates to an improved process for the reprocessing of carbon containing wastes by pretreating the same thermally in the presence or absence of hydrogen, followed by hydrogenation of the pretreated material at elevated temperature and at least 200 bar hydrogen pressure.

19 Claims, No Drawings

PROCESS FOR THE REPROCESSING OF CARBON CONTAINING WASTES

This application is a continuation of application Ser. No. 004,654, filed Jan. 20, 1987, now abandoned

BACKGROUND OF THE INVENTION

It is known in the public and to the artisan that wastes, which accumulate worldwide, represent an increasing problem with regard to environment.

For many years wastes have been disposed of by landfilling, for example in abandoned pits and remote areas. For a long time the chemical structure of wastes and their long term effects on soil and ground-water have not been taken sufficiently into consideration. During recent years hazardous wastes have been disposed of at special sites where measures have been taken to prevent leaking into the ground. In the future however also at these sites environmental contaminations are to be expected.

Consequently extensive endeavours have been undertaken in order to reprocess wastes and to obtain on the one hand improvements with regard to environmental contaminations and on the other hand useful products from wastes.

In "The Oil and Gas Journal" of Dec. 25, 1978, page 80, for example a pilot plant is described for the pyrolysis of plastics, whereby gases and fuel oils are obtained.

In "Hydrocarbon Processing", Apr. 1979, page 183, an incineration system is described, which is particularly suited for burning hazardous wastes.

Also the biochemical degradation of plastics has been investigated (see for example: European Chemical News, Sept. 10, 1979, page 28). In "Chemical Engineering", Aug. 13, 1979, page 41, the solidification of hazardous wastes is described by mixing wastes with solidifying materials like cement.

A survey of the most important processes for handling waste materials is presented in "Chemical and Engineering News", Oct. 1, 1979, page 34. Particular emphasis is laid on gasification of biomass, for example of wood and related feedstocks. Products are essentially carbon monoxide and hydrogen.

On page 36, left column, a test program is disclosed for the conversion of wood, suspended in water, in the presence of hydrogen and Raney-nickel.

In "Europa Chemie", 25, 1979, page 417, a process for the plastification and molding of mixed plastic waste is described. The fluidized bed incineration of wastes is described in "Chemische Industrie", XXXII, Apr. 1980, page 248.

The conversion of wastes and biomass by treatment with water and alkali is described in "Chemistry International", 1980, No. 4, page 20. Numerous additional publications in the field of waste treatment are known.

In recent years, in particular waste incineration has been developed and large-sized technical units have been constructed. Although dust removal and flue gas scrubbing have been integrated into these units, contaminations like heavy metals, $SO_2$, $NO_x$ and others, escape into the atmosphere even under very advanced operating conditions. Furthermore by incineration, valuable synthetic organic materials, which are at least in part, rich in hydrogen are converted into $CO_2$ and $H_2O$.

In the meantime pyrolysis is also carried out on a technical scale (see for example: "Vereinigte Wirtschaftsdienste GmbH", Oct. 4, 1985, page 9.) Disadvantages of pyrolysis are the predominant formation of gases and of considerable quantities of a strongly contaminated coke residue.

The description of the state of the art indicates that the problem of reprocessing wastes has hitherto not been solved satisfactorily.

A non-obvious, much more favorable solution to this problem compared to the state of the art in particular with regard to high yields of valuable liquid products, is disclosed in the German patent application DE-OS No. 34 42 506.3 and in the subsequent European application No. 85 11 4535.9 of the same applicant.

This invention concerns the hydrotreatment with or without catalysts, of synthetic waste materials like plastics respectively plastic mixtures, rubber, waste tires, textile wastes, industrial chemical wastes, waste oils, used oils and others, or mixtures of these materials and is carried out at pressures of 30–500 bar, preferably of 50–450 bar and particularly preferable of 50 to 350 bar, and at temperatures of 200°–600° C., preferably at 200°–540° C. and particularly preferable at 300° to 540° C., and at residence times of 1 minute to 8 hours, preferably of 10 minutes to 6 hours and particularly preferable of 15 minutes to 4 hours. Pasting oils can be added to the feed as well as coal, coal components, crude oil, crude oil components and residues, oil shale and oil shale components, oil sand extracts and their components, bitumen, asphalt, asphaltenes and similar materials. The feed respectively feed mixture can also be pretreated with a solvent and subsequently the extract fed to the hydrotreatment.

The process permits, after separation of inorganic components like glass, metals, stone materials and others, to convert waste materials without further separation into valuable hydrocarbons. These are $C_1$–$C_4$ gaseous hydrocarbons, liquid hydrocarbons in the naphtha range, as well as middle distillates and heavy oils, which can be used as heating oils and diesel fuel. Preclassified waste materials can also be converted, in particular in such a way, that carbon containing organic wastes of synthetic origin, like for example plastics and mixtures of plastics, rubber, waste tires, textile waste, respectively mixtures of these materials and other organic synthetic wastes are at least roughly separated from the vegetable or biomass portion and subsequently submitted to a separate hydrotreatment, or combined with industrial organic wastes of synthetic origin, like coatings and paint resids or organic chemicals, wastes of industrial production units, organic synthetic shredding waste of the motor-vehicley industry, sewage sludge or used-oils or other industrial organic wastes of synthetic origin.

Other waste materials like paper, food residues, farm and wood wastes, plant residues and others can roughly be separated or remain in the synthetic portion to a certain extent.

Garbage can for example be reprocessed in such a way that plastics, rubber, textiles and other synthetic materials are roughly separated and separately submitted to hydrotreating, or combined with waste tires and/or industrial chemical and plastic waste and/or used-oils and others as described above.

The process is also very well suited for hydrotreatment of the above-named wastes resp. waste mixtures in combination (mixed) with coal, coal components like for example residual oils derived from coal, coal oils, pyrolysis oils, crude oil, residual oils derived from crude oil, other crude oil components, oil shale and oil shale components, oil sand extracts, asphalt and bitumen and similar materials, as well as with mixtures of these materials.

The separation of the above-named inorganic materials from carbon containing waste materials can be carried out according to the state of the art. These inorganic materials can be disposed of by landfill for example, if they are not recycled and reprocessed separately. Crushing or shredding and separation of waste material can be carried out according to the state of the art. If the construction of the processing devices is not prohibitive, the process can also be carried out in the presence of inorganic materials.

Waste components, which can not be converted into hydrocarbons, like for example sulfur, nitrogen, oxygen and halogens, in the form of their compounds are converted into their gaseous hydrogen compounds, i.e. $H_2S$, $NH_3$, HCl, $H_2O$ and others. These compounds can be separated by gas scrubbing and be further processing according to the state of the art.

In addition, the formation of hazardous compounds, which are obtained by waste incineration, like $NO_x$, $SO_x$ or of dioxines is avoided according to this process. Furthermore plastics like polyvinyl chloride, which are difficult to incinerate, can be processed without risk with regard to environment.

Hydrogenation of carbon containing waste materials can be carried out according to this disclosure with very good results in the absence of catalysts. However even improved results can be obtained in particular with regard to the selectivity of formation of certain hydrocarbon fractions, in the presence of catalysts, like for example in the presence of metals and compounds, which are catalytically active in hydrogenation like for example Fe, Cr, Zn, Mo, W, Mn, Ni, Co, Pt, furthermore alkali and alkaline earthes like Li, Na, K, Rb, Pd, Be, Mg, Ca, Sr or Ba and other metals and/or their compounds, whereby these catalysts can consist of a single active component or a mixture of at least two of the components and whereby these components may be applied on catalyst carriers for example on alumina, silica, aluminum silicate, zeolites, other carriers which are known to the artisan as well as mixtures of these carriers or without carriers. Also certain zeolites and other carries are active by themselves as catalysts.

Other catalysts which can be used are so-called once-through catalysts like hearth furnace coke (Herdofenkoks), gasification dusts, for example high-temperature-Winkler dust (HTW dust), dusts and ashes obtained by the gasification of coal in the presence of hydrogen, whereby methane is formed (HKV dust), furthermore materials, which contain iron oxides, like so-called red mud, Bayer-mass, Lux-mass, dusts from the steel industry and others. These materials can be used as such or be doped with metals or metal compounds active in hydrogenation, in particular with heavy metals and/or their compounds, like Fe, Cr, Zn, Mo, W, Mn, Ni, Co, Pt, Pd, furthermore alkali und alkaline earthes like Li, Na, K, Rb, Be, Mg, Ca, Sr or Ba, as well as mixtures of these metals and/or metal compounds.

The catalysts can be sulfidized before or during use. The catalysts disclosed can be used as single components or as mixtures of at least two of these components.

The hydrotreatment can take place in wide ranges of temperature and pressure depending on the feed material namely from 200° to 600° C. and 30 to 500 bar at residence times of 1 minute to 8 hours.

The hydrogenating gas can be of different quality, it may contain for example besides hydrogen, certain quantities of CO, $CO_2$, $H_2S$, methane, ethane, steam etc.

Suitable hydrogen qualities are for example those, which are formed by gasification of carbon containing materials. Such materials may be residues from the processing of crude oil and other oils of mineral oil origin, or coal, including lignite, wood, peat, or residues of coal processing operations as for example coal hydrogenation. Appropriate gasification materials may also be biomass and the vegetable portion of garbage. Of course pure hydrogen qualities as for example hydrogen produced electrolytically are also well suited.

Thus, for example garbage can be first separated into a vegetable and into a synthetic portion and subsequently the vegetable portion can be gasified in order to produce hydrogen to be used in the process, whereas the synthetic portion is treated with hydrogen.

According to this process also a treatment with suitable solvents, in particular hydrogen donor solvents can preceed the actual hydrogenation. Subsequently dissolved and undissolved material can be separated from each other and separately subjected to hydrogenation in the hydrogenating reactor or be introduced into the reactor as a whole. By subsequent distillation the solvent can be separated and recycled. The undissolved material can alternatively be subjected to gasification or coking.

Again in this variant the waste material feed can be mixed with coal and coal components, crude oil and crude oil components and other materials as mentioned previously.

Suitable solvents are for example tetraline, anthracene oil, isopropanol, cresols containing oils, decaline, naphthaline, tetrahydrofurane, dioxane and also other hydrocarbons from mineral oil and coal origin or hydrocarbons originating from the hydrogenating unit, as well as oxygen containing hydrocarbons and oils. Finally also water or steam can be added.

Alternatively the waste material can be first separated into a vegetable/biomass/cellulose portion and a synthetic portion and both portions can be processed separately, whereby the vegetable/biomass/cellulose portion is essentially cleaved hydrolytically, for example in the presence of bases or acids, whereby this conversion may be carried out preferentially in the presence of water and/or other protic solvents like alcohols and/or in the presence of carbon monoxide and/or hydrogen, whereas the essentially synthetic portion is hydrotreated as described above.

SUMMARY OF THE INVENTION

An improvement of the process described in DE-PS No. 34 42 506.3 resp. the subsequent European patent application Nr. No. 85 11 4535.9 is disclosed in the present invention, which relates to the treatment of carbon containing organic waste materials of synthetic or predominantly synthetic origin, with hydrogen and/or hydrogen containing gases and/or hydrogen donor solvents optionally in the presence of (a) catalyst(s) characterized in that a, the treatment is carried out at a temperature of 200° to 600° C., preferably of 200° to 540° C., particularly preferable at 300° to 540° C., at a pressure of 30 to 500 bar, preferably at 50 to 450 bar, particularly preferable at 50 to 350 bar and a residence time of 1 minute to 8 hours, preferably of 10 minutes to 6 hours and particularly preferable at 15 minutes to 4 hours, b. the carbon containing organic waste materials of synthetic or predominantly synthetic origin are at least in part exposed to a pretreatment under hydrogen, and/or hydrogen containing gases and/or hydrogen donor solvents at a temperature of 75° to 600° C., preferably of 75° to 540° C. and particularly preferable of 120° to 500° C., at a pressure of 1 to 600 bar, preferably of 1 to 500 bar and particularly preferable of 1 to 350 bar and at a residence time of 1 minute to 6 hours, preferable of 1 minute to 4 hours and/or at least in part exposed to a pretreatment under (an) inert atmosphere, at a temperature of 75° to 600° C., preferably of 75° to 500° C., particularly preferable of 120° to 475° C., at a pressure of 1 to 600 bar, preferably of 1 to 500 bar and particularly preferable of 1 to 350 bar and at a residence time of 1 minute to 6 hours, preferable of 1 minute to 4 hours.

PREFERRED EMBODIMENT

The investigations of applicant have shown that by the inventive pretreatment of wastes to be subsequently hydrogenated, these wastes can be converted into products which can, as a consequence of the viscosities obtained, be handled much easier in subsequent processing steps compared to a treatment of purely melting or dissolving these wastes in a short period of time. Thus the inventive products can be easily pumped or transferred by screw conveyors and also be converted more easily into liquid hydrocarbons in subsequent hydrogenation.

The inventive pretreatment may be carried out in the presence of hydrogen and/or hydrogen containing gases and/or in the presence of hydrogen donor solvents as well as under an inert atmosphere or in solvents, which do not transfer hydrogen. The process can be carried out without catalysts or in the presence of catalysts.

According to the invention the pretreatment is carried out in mixing devices in a general sense, in particular in extruding and mixing/kneading devices because these devices permit transfer to subsequent units essentially without pulsation.

Extruding devices may for example be equipped with single or multiple screws or may be for example constructed according to DE-OS No. 30 01 318 or DE-OS No. 29 49 537. In the latter cases the conveying screw projects into an expanded chamber where additional mixing takes place.

Also numerous other mixing devices are well suited for the inventive treatment, as for example kneading disc-screw extruders, co-kneading machines, hollow screw-heat exchangers, screw kneading machines, kneading-extruders, stirring devices, straight through mixing devices, mixing reactors, kneaders, milling devices like hammer mills, vibrating ball mills, ring roller mills, impact mills and others.

Kneaders, stirring devices and mills may be succeeded by a conveying extruder, which elevates the pressure up to the pressure of the hydrogenating reactor.

According to the invention, devices which are very well suited are those which at the same time permit mixing and kneading. By this way plasticizing, dispersing, homogenization, degassing and degradation reactions take place particularly well, leading to the viscosities desired.

It is also well known that improved mixing leads to increased reaction velocity.

The devices specified above can optionally be additionally adapted to particular waste feeds by gas-inlets, feeding devices at various stages of the pretreatment, drying, heating and cooling distances, feeding devices for liquid fedd etc. In addition, the devices specified above may be connected parallel or in series whereby a feed material for the introduction into the hydrogenation reactor can be produced, which exhibits the desired properties with regard to the degree of degradation and viscosity.

Depending on the type of waste feed, the devices specified above may be preceeded by milling or crushing devices, by separators for the separation of inorganic materials like sand, metalls, stones ets., melting devices, and optionally freeze degradation devices, thus permitting the formation of a specific state of aggregation of the feed materials to be introduced into the treatment devices.

If the inventive pretreatment is carried out in the presence of hydrogen, hydrogen containing gases or hydrogen donor solvents the devices specified are preferentially selected with regard to contacting the feed material with a sufficient quantity of hydrogen. For this purpose for example stirring reactors are useful, or the devices disclosed in DE-OS No. 30 01 318 and DE-OS No. 29 43 537 or other devices specified above which are equipped with inlets for hydrogen. Alternatively hydrogen can be added prior to the pretreatment. According to the invention the hydrotreatment in the pretreatment device is carried out at 75° to 600° C., preferably at 75° to 540° C., particularly preferable at 120° to 500° C., at a pressure of 1 to 600 bar, preferably of 1 to 500 bar, particularly preferable of 1 to 350 bar and a residence time of 1 minute to 6 hours, preferably of 1 minute to 4 hours, whereby the quantity of hydrogen desired is fed at one or several stages depending on the type of mixing device used.

Thermal pretreatment is carried out in the mixing device at 75° to 600° C., preferably at 75° to 500° C., particularly preferable at 120° to 475° C., at a pressure of 1 to 600 bar, preferably of 1 to 500 bar, particularly preferable of 1 to 350 bar and a residence time of 1 minute to 6 hours, preferably of 1 minute to 4 hours.

In principle the inventive pretreatment, in particular thermal pretreatment can be carried out also at subatmospheric pressure.

In the case of thermal pretreatment inert gases may be introduced at one or several stages, depending on the mixing device used. Such gases may be for example nitrogen, carbon dioxide, steam, carbon monoxide, methane, other low boiling hydrocarbons or mixtures of these gases. Also hydrogen may be present in low quantities.

According to the invention also pretreatment devices for hydrotreatment and thermal treatment may be combined parallel or in series. The gases specified above can also be added prior to the actual pretreatment.

A hydrogen donor solvent or a mixture of such solvents may also be added solely or in combination with additional hydrogen or inert gases.

In this case hydrogenative pretreatment is also carried out at temperatures of 75°-600° C., preferably at 75°-540° C. and particularly preferable at 120° to 500° C., at a pressure of 1 to 600 bar, preferably of 1 to 500 bar and particularly preferable at 1 to 350 bar and at a residence time of 1 minute to 6 hours, preferably of 1 minute to 4 hours.

According to the invention the conversion in the mixing device can also take place in the presence of protic solvents, in particular in the presence of water and/or in the presence of methanol and/or of at least one of the group: ethanol, $C_3$–$C_4$-alcohols and higher alcohols.

Protic solvents lead, depending on the type of waste, at least in part to hydrolysis. If the reaction is carried out in the pretreatment device, temperatures are applied of 75° to 600° C., preferably of 75° to 540° C. and particularly preferable of 120° to 500° C., pressures of 1 to 600 bar, preferably of 1 to 500 bar, particularly preferable of 1 to 350 bar and residence times of 1 minute to 6 hours, preferably of 1 minute to 4 hours.

Hydrolysis can also take place in the presence of hydrogen, hydrogen containing gases and hydrogen donor solvents with or without catalysts and/or with or without CO. Typical hydrolysis catalysts like acids or bases including organic amines may be used. The catalysts described on pages 6 and 7 may also be present.

Furthermore the inventive pretreatment can be carried out in the presence of solvents, which do not effect hydrogen transfer, like for example aromatics like benzene, toluene and the xylenes. Also non-aromatic solvents may be used, like for example saturated or essentially saturated aliphatics in boiling ranges between for example 30 to more than 500° C. High boiling fractions may be for example residual oils, as mentioned above.

According to the invention the hydrogenative cleavage in the pretreatment device can be adjusted to the degree desired. Even a degree of cleavage as described in the hydrotreatment disclosed in DE-PS No. 34 42 506 and the subsequent European application Nr. No. 85 11 4535.9 can be achieved. As a result a succeeding hydrotreatment reactor may be unnecessary in such a case.

The hydrogenative pretreatment can be carried out according to the invention with or without catalysts specified on page 6 and 7. Catalysts may be added prior to pretreatment or may be introduced into the pretreatment device.

Wastes resulting from organic synthetic materials can be converted according to the invention into liquid hydrocarbons, boiling essentially in the naphtha resp. gasoline range or middle distillate range. A variety of such wastes is specified on page 3 and 4.

The convertible types of waste however are not limited to those specified above.

A particularly advantageous feature of the inventive process is the fact that—depending on the kind of waste which may contain, as already outlined above, plastic materials, dyes, coating compositions, industrial chemicals, including those chemicals which are disposed of by landfilling at special sites, shredding wastes from the automobil industry, used lubricating oils, elastomers, textile materials, but also to a certain extent paper, cardboard and other cellulose containing materials like wood wastes, sawdust or vegetables from garbage—the conditions in the pretreating device can be adjusted in such a way that a product is obtained, which can be easily handled in subsequent processing steps, for example it can be pumped and transferred by screw conveyors. Alternatively the pretreated product can be conveyed directly from the pretreating device into the hydrogenating unit for example by extruding.

The inventive process thus permits to treat mixtures of waste, which are not or only little preclassifyed.

However pertaining to apparatus it is desirable, to separate inorganic materials like stones, metals, glass and others before pretreatment, at least coarse materials.

Of course preclassifying in for example predominantly vegetables and cellulose containing materials on the one hand and into organic waste of synthetic origin on the other hand is preferred, according to the invention, although vegetables and cellulose containing materials do not have to be separated completely.

These materials, for example vegetables can be processed separately for example by fermentation. An important advantage of the present invention results from the fact that valuable liquid hydrocarbons can be obtained in high yield by the inventive hydrogenative or thermal pretreatment in combination with the subsequent hydrogenation of the pretreated waste even if very inhomogeneous waste mixtures are used as a feed. Furthermore the heteroatoms which are present in many waste materials, like oxygen, sulfur, nitrogen or halogens are converted to their hydrogen derivates, which can be processed further without problems, according to the state of the art.

This is of particular importance in the case of wastes, containing chlorine, bromine or fluorine.

Thus the existing problems of waste elimination in particular in the case of toxic and halogenated wastes are solved by the present invention without risk. Such wastes are for example polychlorobiphenylenes, polyvinyl chloride, fluorine polymers or halogen containing solvents.

A particularly advantageous effect of the thermal or hydrogenative pretreatment is the fact that depending on temperature, residence time and pressure already at the pretreatment stage extensive removal of halogen, essentially as hydrogen halide, takes place. For example from polyvinylchloride containing waste approx. 90% of halogen are removed by formation of hydrogen chloride, already at 250° C., a residence time of 30 minutes and a hydrogen or nitrogen pressure of 10 bar or even less.

The halogen removal can be further improved by increasing temperature and increasing residence time. Additionally improved halogen removal can be achieved by catalysts specified on page 6 and 7. Also catalysts which are used according to the state of the art for splitting off hydrogen halide from organic compounds like catalysts know to the artisan as Friedel-Crafts catalysts and/or organic amines and other basic compounds, can be used according to the invention. As a result hydrogen halides can be removed at comparatively mild conditions.

According to the instant invention also crude oil, components of crude oil and products produced from crude oil, asphalts, bitumen, mineral pitch, coal, coal components, products from coal, lignite, peat, pyrolyses oils for example from coking or pyrolysis, oil sand and oil sand products, residual oils from crude oil processing, cracking units, vacuum residues, oil shale and oil shale products and similar materials can be added to the waste feed, to the pretreatment section or the hydrogenating reactor.

Depending on the kind of waste a hydrolytic stage can preceed the thermal or hydrogenative pretreatment. In this case the hydrolytic reaction is preferrentially carried out in a mixing device, as described above, in the presence of protic solvents, in particular in the presence of water and/or methanol and/or at least one of the group: ethanol, $C_3$–$C_4$-alcohols and higher alcohols at a pressure of 1 to 150 bar, preferably of 1 to 120 bar and a temperature of 50° to 300° C. and preferably of 75° to 250° C. Low pressures are preferred if it is intended to remove gases which are formed during hydrolysis from the hydrolysis device.

Under certain conditions, the hydrolysis stage may alternatively be installed between the pretreatment and hydrogenating stage. In this case the hydrolysis conditions would be preferably adapted to the temperature and pressure conditions of the pretreatment stage or hydrogenating stage or to both of them.

Vegetables and biomass can thus be hydrolytically cleaved and separated from the waste which originates from organic synthetic materials. The hydrolytic reaction can be accelerated by acids or bases in accordance with the state of the art. The hydrolytic reaction can also be carried out in the presence of hydrogen, hydrogen containing gases, hydrogen donor solvents, catalysts as outlined above or other solvents which do not transfer hydrogen, or in the presence of inert gases. So-called pasting oils can also be used according to the invention in the pretreatment section or a preceeding or subsequent reaction. The pasting oils may originate from the waste processing unit itself or may originate from other sources.

According to the invention metals resp. metal compounds which are present in wastes, can be worked up easily, since they are usually recovered as ashes after hydrogenation and work up of the hydrogenation products. These residual materials which contain the metals in a relatively high concentration can be recycled to metal processing plants.

EXAMPLES

Example 1

A mixture of essentially organic synthetic waste originating from a technical waste classifying plant, without polyvinyl chloride and other chlorine containing waste materials, is mixed with a used lubricating oil in a ratio of waste to oil of 1:3 and is treated for two hours at a hydrogen pressure of 10 bar and temperatures of 250° C., 300° C. and 350° C. in a stirring reactor.

The products which were pumpable had viscosities as outlined in table 1.

TABLE 1

| temp. °C. | viscosity, mPas 160° C. | 140° C. |
|---|---|---|
| 200 | 652 | 985 |
| 250 | 586 | 916 |
| 300 | 510 | 760 |
| 300 ratio:waste to oil = 1:2 | 2482 | 3978 |
| 350 | 91 | 134 |
| 350 ratio:waste to oil = 1:2 | 480 | 860 |

Example 2

Example 1 was repeated, however at a nitrogen pressure of 10 bar.

Only at the temperature of 300° C., additionally a pressure of 2 bar of nitrogen was applied.

The results are presented in table 2.

TABLE 2

| temp. °C. | viscosity, mPas 160° C. | 140° C. |
|---|---|---|
| 200 | 501 | 743 |
| 250 | 459 | 697 |
| 300 | 451 | 701 |
| 300 ratio:waste to oil = 1:2 | 2618 | 4522 |
| 300 (2 bar) | 331 | 495 |
| 350 | 77 | 115 |
| 350 ratio:waste to oil = 1:2 | 442 | 796 |

Example 3

A mixture of essentially synthetic waste originating from a technical waste classifying unit, which contained 10 weight-% of polyvinyl chloride was mixed with a used lubricating oil in a ratio of waste to oil of 1:3 as described in example 1 and was exposed to temperatures of 250° C., 300° C. and 350° C. for two hours each at a pressure of 10 bar of nitrogen resp. hydrogen.

Pumpable products were obtained with viscosities presented in table 3.

TABLE 3

| temp. °C. | viscosity, mPas 160° C. | 140° C. | residual chlorine content based on original chlorine content in % |
|---|---|---|---|
| 250 $H_2$ | 480 | 720 | 5,5 |
| 250 $N_2$ | 394 | 697 | 6 |
| 300 $H_2$ | 288 | 451 | 3,5 |
| 300 $N_2$ | 374 | 571 | 4 |
| 350 $H_2$ | 45 | 68 | 2 |
| 350 $N_2$ | 53 | 76 | 3 |

Example 4

A mixture of 90 weight-% of essentially organic waste of synthetic origin, obtained from a technical waste classifying plant and 10 weight-% of waste paper mixed with a mineral residual oil in a ratio of waste to oil of 1:3 was treated for 20 minutes at 20 bar under hydrogen in a double-screw mixing/kneading device at 150° C., 250° C. and 350° C. in the presence of a catalyst, consisting of a hearth furnace coke, which was doped with 5 weight-% of $FeSO_4$.

Pumpable products were obtained with viscosities presented in table 4.

TABLE 4

| temp. °C. | viscosities, mPas 160° C. | 140° C. |
|---|---|---|
| 150 | 5560 | 6920 |
| 250 | 4720 | 5335 |
| 350 | 528 | 748 |

Example 5

A mixture of mineral residual oil with a mixture consisting of 10 weight-% of waste tires, 70 weight-% of essentially synthetic organic waste from a technical waste classifying plant and 20 weight-% of polyvinyl chloride was treated in a mixing/kneading device for 20 minutes at 350° C. and 450° C., at a pressure of 200 bar of hydrogen resp. nitrogen. The ratio of waste to oil was 1:3. $FeSO_4$, treated with NaOH was used as catalyst.

Pumpable products were obtained with viscosities presented in table 5.

TABLE 5

| temp. °C. | viscosity, mPas 160° C. | viscosity, mPas 140° C. | residual chlorine content based on original chlorine content in % |
|---|---|---|---|
| 350/$H_2$ | 157 | 208 | 0,1 |
| 350/$N_2$ | 185 | 253 | 2 |
| 450/$H_2$ | 98% oils with boiling range <500° C. | | 0,001 |

Example 6

Waste, consisting essentially of organic synthetic materials, originating from a technical waste classifying plant, which contained 15 weight-% of polyvinyl chloride, was treated in a mixing/kneading device at 200 bar hydrogen and temperatures of 350° C. and 470° C. for 30 minutes.

At 350° C., the reaction was carried out with (Ni/Mo) and without catalyst. No pasting oil was used. The viscosities obtained are presented in table 6.

TABLE 6

| temp. °C. | viscosity, mPas 160° C. | viscosity, mPas 140° C. | residual chlorine content based on original chlorine content in % |
|---|---|---|---|
| 350/$H_2$/Ni/Mo | 720 | 892 | 0,1 |
| 350/$H_2$ | 1080 | 1474 | 0,5 |
| 470/$H_2$ | 88% oils with boiling range <500° C. | | 0,001 |

Example 7

Waste, consisting essentially of the following hard plastic materials (without film forming plastic) originating from a technical waste classifying plant:

60 weight-% of polyethylene and polypropylene
10 weight-% of polyvinyl chloride
15 weight-% of polycarbonate and
15 weight-% of polyamide was mixed with crack vacuum distillate in the ratio of waste to oil of 1:3 and treated under nitrogen of 10 bar at temperatures of 200° C. and 250° C. at residence times of 1 hour resp. 2 hours in a kneading device. The viscosities obtained are presented in table 7.

TABLE 7

| temp. °C. | viscosity, mPas 200° C. | viscosity, mPas 220° C. | residence time hours | residual chlorine content based on original chlorine content in % |
|---|---|---|---|---|
| 200 | 1480 | 1220 | 2 | 8 |
| 250 | 460 | 270 | 2 | 5 |
| 200 | 1495 | 1238 | 1 | 9 |
| 250 | 525 | 322 | 1 | 6 |

Example 8

Waste, consisting essentially of organic synthetic materials, origination from a technical waste classifying plant, which contained 5 weight-% of perfluorinated polyethylene (teflon) and 20 weight-% of textile waste consisting of wool and polyacrylonitrile in a ratio of 1:1 was treated as describes in example 6.

The viscosities obtained are presented in table 8.

TABLE 8

| temp. °C. | viscosity, mPas 160° C. | viscosity, mPas 140° C. | residual fluorine content based on original fluorine content in % | residual nitrogen content based on original content in % |
|---|---|---|---|---|
| 350/$H_2$/Ni/Mo | 700 | 854 | 0,15 | 0,01 |
| 350/$H_2$ | 990 | 1393 | 0,42 | 0,01 |
| 470/$H_2$ | 91 weight-% oils with boiling range <500° C. | | 0,001 | 0,0005 |

These examples show that under nitrogen as well as under hydrogen, degradation of the feed materials takes place in the mixing devices, furnishing products which can subsequently easily be handled by pumping respectively by conveying. This is true also in cases where wastes are processed, which consist of very heterogeneous materials.

The examples also show that at higher temperatures, like for example at 450° C. nearly quantitative yields of oils with a boiling range <500° C. can be obtained. Furthermore the results presented in tables 3, 5, 6, 7 and 8 show that the inventive pretreatment leads to an extensive removal of chlorine, fluorine and nitrogen. This is also true under relatively mild conditions like 250° C. and 10 bar or less of nitrogen resp. hydrogen.

This is of great importance for waste hydrogenation at a technical scale, since the succeeding hydrogenation reactors and other equipment which is exposed to high pressures, can be constructed by using less expensive materials.

In addition the surprising, non-obvious result has been obtained, that by processing waste materials containing chlorinated materials under inert gases resp. hydrogen, increased degradation of waste feed takes place compared to waste feed which does not contain chlorinated materials.

Thus the inventive process is of particular advantage in the case of waste feeds, which contain chlorinated materials.

The examples also show, that under suitable conditions and ratios of waste to pasting oils, an increased degradation takes place under an inert gas like nitrogen compared to hydrogen.

Depending on the feed mixture the viscosity may after a first decrease, increase again with increasing temperature. If the temperature is raised further, the viscosity finally decreases again.

Since the pretreatment can be carried out at conditions which are variable in a broad range, the conditions of hydrogenation, which succeeds the pretreatment can also be varried in broad ranges, both treatments supplementing each other.

If, for example, the inventive pretreatment is carried out at relatively high temperature and residence time, or corresponding pressure, in particular relatively high hydrogen pressure, the hydrogenation can, depending on the type of waste feed, be carried out at relatively mild conditions. This is in particular the case, if the pretreatment stage leads already to extensive degradation.

Vice versa relatively mild conditions at the pretreatment stage can be compensated for at the hydrogenation stage by more severe conditions.

Both stages thus supplement each other according to the invention and can, if necessary, be excellently adapted to the waste feed material.

What we claim is:

1. In an improved process for the treatment of waste materials comprising carbon containing, synthetic organic materials with hydrogen, hydrogen containing gases, hydrogen donor solvents or mixtures thereof with or without a catalyst, the improvement comprises:

(a) pretreating the waste materials at least in part by exposing said materials to hydrogen, hydrogen containing gases, hydrogen donor solvents or mixtures thereof at a temperature of 75°–600° C., at a pressure of 1 to 600 bar, and at a residence time of 1 minute to 6 hours, or to an inert atmosphere, at a temperature of 75° to 600° C., at a pressure of 1 to 600 bar, and at a residence time of 1 minute to 6 hours, and then, conveying the thus treated material to a separate vessel and (b) hydrogenating the pretreated material from (a) with hydrogen, hydrogen-containing gases, hydrogen donor solvents or mixtures thereof at a temperature of 200° to 600° C., at a pressure of 30 to 500 bar, and a residence time of 1 minute to 8 hours.

2. An improved process according to claim 1 wherein the organic waste material contains vegetable waste or other cellulose containing waste.

3. An improved process according to claim 1 wherein step (a) is carried out in the presence of a protic solvent at a temperature of 75° to 600° C., at a pressure of 1 to 600 bar and at a residence time of 1 to 6 hours.

4. An improved process according to claim 3 wherein step (a) is preceded by contacting the organic waste material with a protic solvent at a temperature from 50° to 300° C., at a pressure of 1 to 150 bar and a residence time of 1 to 4 hours.

5. An improved process according to claim 3 wherein the protic solvent is water, a $C_1$–$C_4$ alcohol, or mixtures thereof.

6. An improved process according to claim 1 wherein step (a) is carried out with mixing, kneading or stirring.

7. An improved process according to claim 1 wherein the organic waste material is processed in a mixture with at least one member selected from the group consisting of whole crude oil, crude oil components, coal, coal components, oil shale, oil shale components, oil sand, oil sand components, pyrolysis oils, components of pyrolysis oil, bitumen, bitumen components, asphalt, asphaltenes, asphalt components, asphaltene components, pasting oils originating from the hydrogenation or thermal treatment of waste, pitch, pitch components, biomass, biomass components, garbage, garbage components, peat and peat components.

8. Improved process according to claim 1 wherein step (a) or (b) or both are carried out in the presence of a catalyst which contains at least one member selected from the group consisting of Fe, Cr, Pt, Pd, Zn, Mo, W, Mn, Ni, Co, V, alkali, alkaline earths and compounds of these metals, said catalyst being supported on catalyst carriers comprising alumina, silica, aluminum silicate, zeolithes or hearth furnace coke.

9. Improved process according to claim 1 wherein step (a) or (b) or both conducted in the presence of a catalyst which contains at least one member selected from the group consisting of Fe, Cr, Mo, W, Mn, Ni, Co, V, Pt, Pd and their compounds with or without a carrier.

10. Improved process according to claim 1 carried out in the absence of a catalyst.

11. Improved process according to claim 1 wherein the organic waste materials contain chlorinated materials.

12. Improved process according to claim 1 wherein step (a) is carried out under an inert gas atmosphere.

13. Improved process according to claim 12 wherein the inert gas comprising nitrogen, steam, $CO_2$ or mixtures thereof.

14. An improved process according to claim 1 wherein the organic waste material is polyethylene, polypropylene, polyvinyl chloride, polycarbonate, polyamide or mixtures thereof.

15. An improved process according to claim 14 wherein the organic waste material is polyvinyl chloride.

16. An improved process according to claim 1 wherein the organic waste material comprises perfluorinated polyethylene.

17. A process according to claim 1 wherein the waste materials contain rubber.

18. A process according to claim 1 wherein the waste materials comprise used oil.

19. A process according to claim 1 wherein the waste materials comprise textile wastes.

* * * * *